United States Patent [19]

Abblett

[11] Patent Number: 4,764,029

[45] Date of Patent: Aug. 16, 1988

[54] DISPOSABLE AND COLLAPSIBLE TRASH RECEPTACLE

[76] Inventor: Donald R. Abblett, 172 W. Janss Cir., Thousand Oaks, Calif. 91360

[21] Appl. No.: 69,355

[22] Filed: Jul. 2, 1987

[51] Int. Cl.[4] ..... B65D 30/16

[52] U.S. Cl. ..... 383/104; 383/77; 383/120; 383/121; 383/71; 220/404; 229/4.5

[58] Field of Search ..... 383/77, 104, 120, 2, 383/119, 122, 71; 220/1 T, 404; 229/5.5, 4.5, 41 C; 428/542.8

[56] References Cited

U.S. PATENT DOCUMENTS

| | | | |
|---|---|---|---|
| 1,124,747 | 1/1915 | Karr | 383/71 |
| 1,245,256 | 2/1917 | Miller | 220/1 T |
| 1,293,316 | 2/1919 | Bogert | 229/41 C |
| 1,555,115 | 8/1925 | Hand | 229/41 C |
| 1,691,904 | 11/1928 | Gamble | 383/104 |
| 2,300,473 | 11/1942 | Van Winkle | 229/4.5 |
| 3,148,799 | 9/1964 | Meroney | 220/404 |
| 3,185,339 | 5/1965 | Fleming | 220/1 T |
| 3,658,233 | 4/1972 | Votko | 220/1 T |
| 3,670,946 | 6/1972 | Croley | 229/4.5 |
| 4,445,230 | 4/1984 | Spadaro | 383/77 |
| 4,628,007 | 12/1986 | Ledsham | 428/542.8 |

FOREIGN PATENT DOCUMENTS

| | | | |
|---|---|---|---|
| 2570680 | 9/1984 | France | 383/120 |
| 2176463 | 12/1986 | United Kingdom | 220/1 T |

*Primary Examiner*—Willis Little

*Attorney, Agent, or Firm*—Richard D. Slehofer

[57] ABSTRACT

A disposable and collapsible water resistant trash receptacle has a pleated sidewall comprising the side cylindrical portion of the container and a circular bottom attached to the bottom of the cylindrical portion. The upper portion of the sidewall forms an integral lid and has pairs of tie tabs so that when the receptacle is full of trash, the lid is pulled up and the pairs of tie tabs can be tied together to seal off the receptacle when full of trash. The longitudinal pleating and the type of material employed for forming the sidewall gives the receptacle sufficient rigidity so that it is freestanding when in the opened position. Additionally the pleating allows the sidewall to compress inwardly forming a compact, elongate tube for transport and sale. Further features of the basic receptacle include vertical stiffeners attached or molded into the sidewall to increase its rigidity and a transverse reinforcing strip for increasing the rigidity around the area forming the rim of the receptacle. The pleated reinforcement strip has above it a transverse crease for providing a demarcation line for folding back down the upper portion of the sidewall to provide a large mouth opening when trash is being inserted into the interior of the receptacle.

20 Claims, 3 Drawing Sheets

DISPOSABLE AND COLLAPSIBLE TRASH RECEPTACLE

BACKGROUND OF THE INVENTION

1. Field of the Invention

The present invention pertains to trash receptacles and in particular to collapsible receptacles which can be opened up to form a freestanding trash container for holding trash until it is full and in turn being tied off and easily disposed of.

2. Description of the Prior Art

Trash cans and trash bags are well known in the prior art. Everyone is familiar with the traditional 32 gallon galvanized metal trash can having a cylindrical configuration with a metallic bottom and a detachable dome shaped lid which fits over the rim of the trash can by a frictional compression fit. The drawback to a metal container for trash is that the metal is easily deformable when the can is emptied by the trash collector on collection day. Furthermore, the galvanizing eventually erodes causing rusting and the creation of holes in the bottom of the trash can. A metal trash can has a limited useful life.

Plastic trash cans are also well known in the art. They are similar to the configuration to the traditional galvanized trash can, but have the lid sealable over the rim of the container by plastic catches of some type. Plastic trash cans do not rust nor are they dentable. However, they easily crack or tear after a short period of use. Also, plastic and metal containers must be put away, from street or alley, after trash pick up has been completed.

Recently, plastic trash can liners and plastic trash bag holders have become popular household items. A typical trash can liner is comprised of a plastic sheet folded back upon itself and heat sealed along the vertical and bottom edges to form a seam. It is basically a limp rectangular shaped article which can be inserted into the interior of the trash can with the open end of the trash bag liner folded over the rim of the garbage can to be held in place as refuse accumulates inside the trash can. The liner, after it is full, can be removed from the trash can, tied off with a twist tie and then disposed of for pick up by the trash collector. The interior of the trash can remains clean and sanitary.

There are also trash bags made from a stronger plastic material in order to hold heavier contents and having a closable mouth by means of a built-in drawstring or sealable by a twist tie.

None of these trash can liners or garbage receptacles have any rigidity. They lie flat on the ground until they are stuffed full of garbage to give them a three dimensional shape. Even then, the full bags are not freestanding and are not rigid.

SUMMARY AND OPERATION OF THE INVENTION

A disposable and collapsible water resistant trash receptacle has a pleated sidewall comprising the side cylindrical portion of the container and a circular bottom attached to the bottom of the cylindrical portion. The upper portion of the sidewall forms an integral lid and has pairs of tie tabs so that when the receptacle is full of trash, the lid is pulled up and the pairs of tie tabs can be tied together to seal off the receptacle when full of trash. The longitudinal pleating and the type of material employed for forming the sidewall gives the receptacle sufficient rigidity so that it is freestanding when in the opened position. Additionally the pleating allows the sidewall to compress inwardly forming a compact, elongate tube for transport and sale. Further features of the basic receptacle include vertical stiffeners attached or molded into the sidewall to increase its rigidity and a transverse reinforcing strip for increasing the rigidity around the area forming the rim of the receptacle. The pleated reinforcement strip has above it a transverse crease for providing a demarcation line for folding back down the upper portion of the sidewall to provide a large mouth opening when trash is being inserted into the interior of the receptacle.

The first step in making the invention is to cut a generally rectangular piece of material as shown in FIG. 5, FIG. 6, or FIG. 7. The sidewall material which will hold a crease is stiff yet pliable, and is water resistant. If the tie tabs are to be integrated as part of the receptacle, then arch-shaped cut outs will be made as shown in FIG. 5 or FIG. 7. The next step is to make the longitudinal pleats which can be of a ½ inch to a 1 inch width. After the pleating process, the two side ends are joined together and sealed by means of a heat seal or an appropriate adhesive. The bottom piece, which has a diameter slightly larger than the diameter of the sidewall, is likewise heat sealed or otherwise glued to the bottom edge of the sidewall. The basic invention is then ready for use. The upper portion below the top edge can be folded back down upon the exterior surface of the lower portion of the sidewall to create a large mouth opening and to help increase the rigidity and freestanding capability of the receptacle as shown in FIG. 2.

Various modifications to the basic invention can be made for example by gluing a series of rigid stiffeners in a longitudinal fashion as shown in FIG. 6, or molded in sidewall material before pleating and then all pleated together. The stiffeners are equally spaced in a longitudinal fashion to the sidewalls after the sidewall has been pleated. The stiffeners can be fabricated from rigid plastic rods or strips. Furthermore, there can be a transverse crease placed on the sidewall as shown in FIG. 6. This transverse crease provides a line at which the upper portion is folded back over the lower portion of the outer sidewall by providing for a nice demarcation for this folding point and also for creating a rigid rim at the opening of the receptacle when in use. The transverse crease also helps keep the sidewalls open so the pleats do not fold back to a collapsed position again. A further modification to the sidewall before the sides are sealed together can be in addition to or in place of the transverse crease, a lateral reinforcing strip of plastic or other suitable material near the crease area to give the rim of the receptacle more rigidity. This laterally placed strip of plastic will have to be adhered to the sidewall before the sidewall is pleated since the reinforcing strip would also have to be pleated in order to allow the receptacle to compress inwardly. Alternatively, the lateral stiffener means could be formed from a part of the sidewall. Before the sidewall is pleated, a lateral double fold could be made in the upper portion of the sidewall. One side of the extending flap formed by the double fold could then be glued to the sidewall.

The circular bottom section which forms the bottom of the receptacle can be made of any type of a plastic material, or it could be radially pleated from a stiff type of material such as used in the sidewall construction.

After the receptacle is fabricated, the pleats of the sidewall are folded together and the sidewall is compressed inwardly. During the process of compressing the sidewall, the bottom is stuffed into the lower interior compartment as the pleats are folded together. After the maximum inward compression is reached, the bottom will be stuffed into the interior tube as far as it will go. Additionally, the upper portion has been previously folded back along the lateral crease as shown in FIG. 2. When the maximum inward compression has been reached, the receptacle will look like that shown in FIG. 1. One or more receptacles can be packaged together for transport to and sale at a typical hardware store or supermarket. The purchaser of the article simply removes one of the elongate tubes from its package and proceeds to open up and expand the compressed sidewall. The bottom then will drop downwardly forming the bottom area. At this point the upper portion of the sidewall will be folded over at the transverse crease line forming a rim to keep the receptacle from closing back again and to make the rim stiffer. The receptacle will be in an opened upright position as shown in FIG. 2. The receptacle is freestanding because of the rigidity of the sidewall material, the pleats and/or the vertical stiffeners.

Leaves, cuttings, lawn clippings etc., can be introduced into the interior until such time as the receptacle becomes full. In that event, the overhanging upper portion of the sidewall is pulled up and the pairs of tie tabs are tied together for sealing the full receptacle. The two hand cut outs are used to transport the full receptacle to the appropriate area for pick up and disposal by the trash collector.

In the other version where the tie tabs are not formed along the upper edge (FIG. 6), the upper portion is simply crimped together to form a neck, and a wire string or twist tie is used to tie off and seal the top opening of the receptacle.

The bottom and sidewalls forming the receptacle are made of a waterproof material so that moisture cannot penetrate and soften the sidewall material itself to weaken the integrity of the sidewall.

After the receptacle is full and tied off it can be disposed of accordingly.

DETAILED DESCRIPTION OF THE PREFERRED EMBODIMENTS

Figure 1:
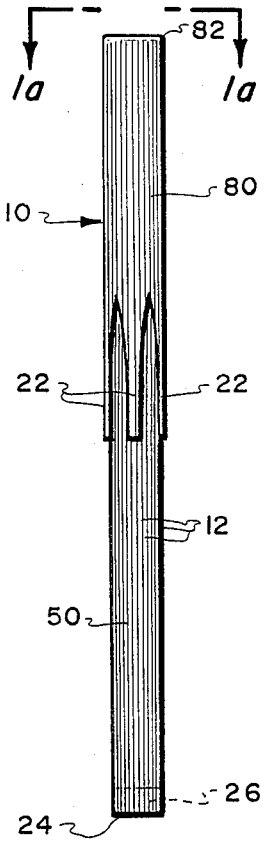
FIG. 1 illustrates the invention compressed inwardly and forming an elongate tube for transport and sale.
Figure 1A:
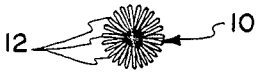
FIG. 1A illustrates the end view of the compressed receptacle taken along the lines 1A—1A in FIG. 1.

Referring to the drawings FIG. 1 illustrates the receptacle in its closed position. FIG. 1A shows the end view of the closed position. The pleated sidewall has been compressed inwardly forming a elongate tube. The compressed receptacle is packaged and transported and sold in its closed position as an elongate tube. After the purchaser unpacks the receptacle and opens it up, the receptacle is expanded to a freestanding position as shown in FIG. 2.

Figure 2:
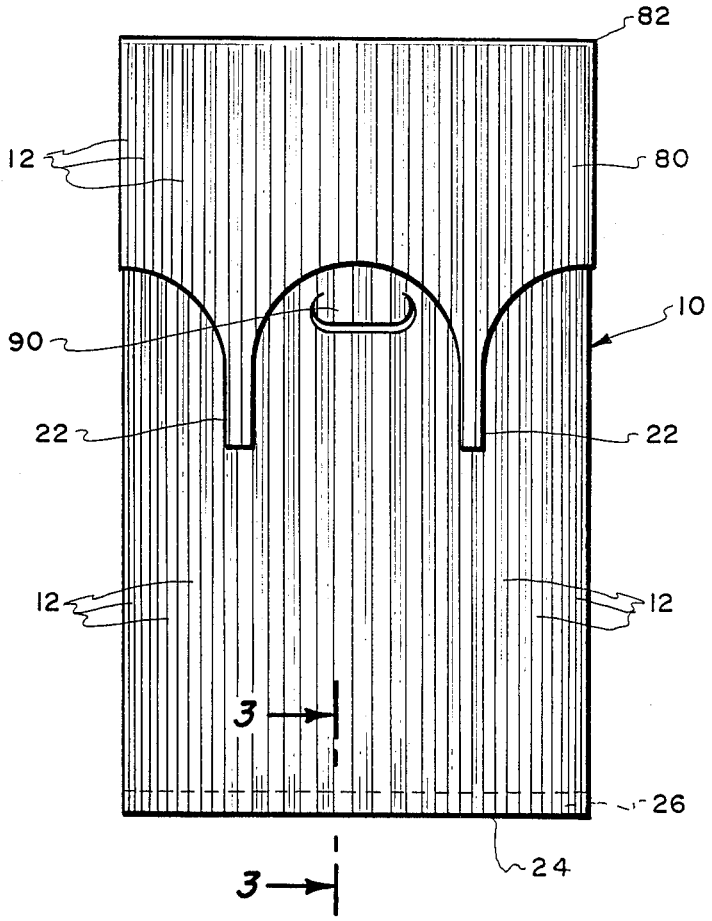
FIG. 2 is a front elevational view of the invention in its opened and freestanding position having the top portion folded back down against the outer sidewall.
Figure 4:
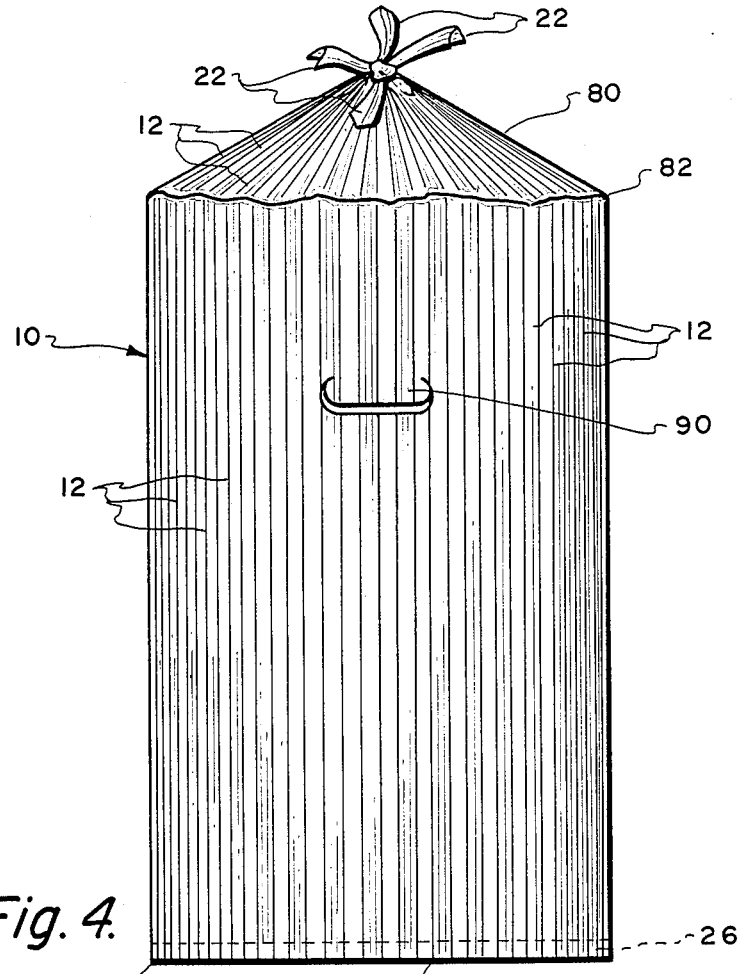
FIG. 4 is a front elevational view illustrating the freestanding receptacle full of refuse and tied off by means of the two pairs of tie tabs.

FIG. 2 is a front elevational view of the receptacle in its opened position ready to receive trash and other types of refuse. After the interior of the receptacle is full of trash and other refuse, the top portion of the sidewall is pulled up and the tie tabs are then tied off as illustrated in FIG. 4. The full disposable receptacle is then conveniently set out for pick up by the garbage collector. The receptacle is used as a throw away trash can.

Figure 5:
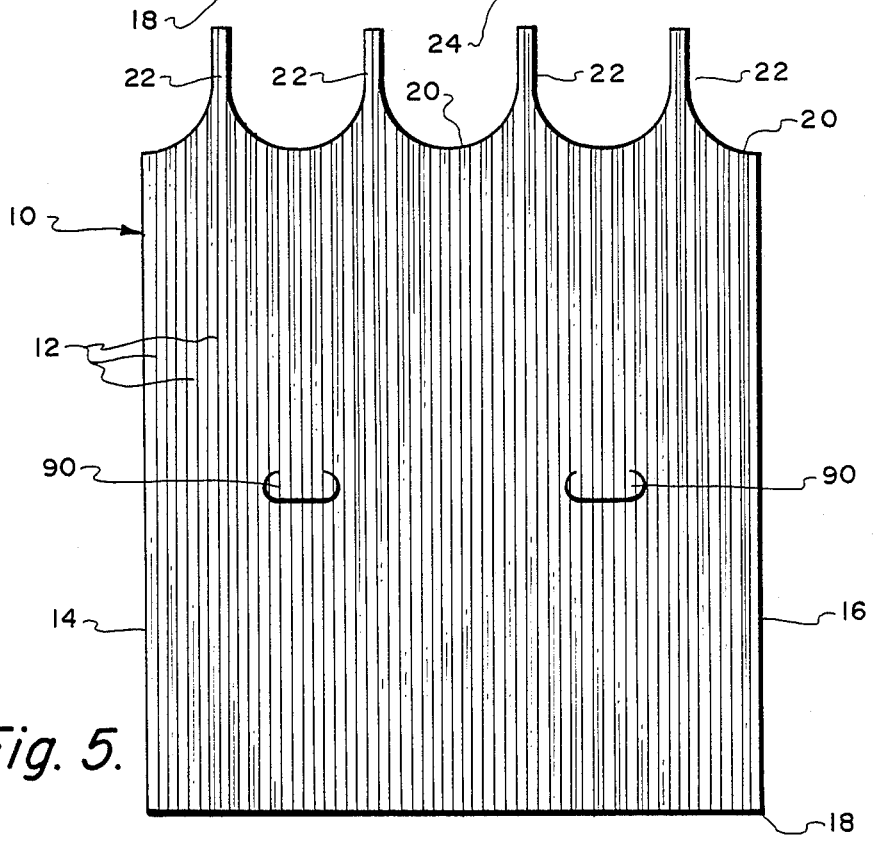
FIG. 5 illustrates the sidewall of one embodiment of the invention before the two side ends are joined together. The pleating and the two pairs of tie tabs are clearly illustrated.
Figure 7:
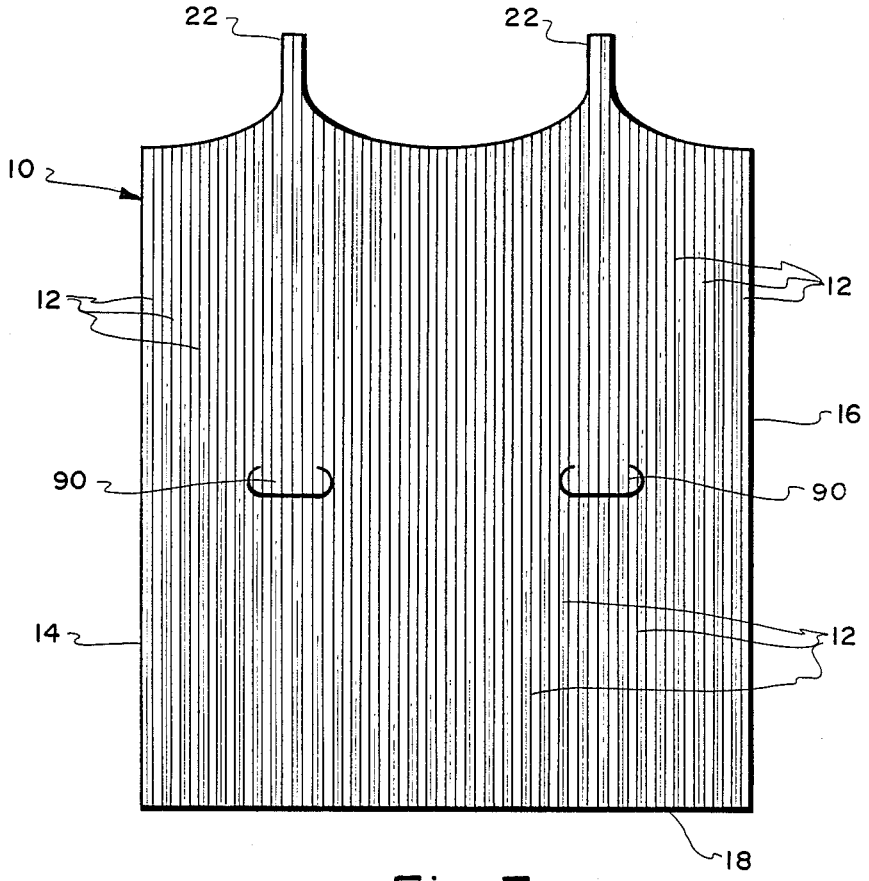
FIG. 7 is similar to FIG. 5 and illustrates the sidewall. In this version, there two opposed ties for forming one pair of opposed tie off tabs.

Referring now to FIG. 5, there is disclosed a generally rectangular sheet of material labeled 10. This sheet is cut out from a standard pattern of this type. The material forming the sheet can be any type of material which will hold a crease, is stiff yet sufficiently pliable and is also water resistant. One type of material which was experimentally found to be acceptable is the type of material used to package potato chips and other snack food products. Bell brand potato chip packagers purchase this type of material from a company called Advanced Film Technology. Advanced Film Technology calls their material "liner stock". Any type of olefin material, such as polypropylene would be acceptable. The parallel series of longitudinal lines illustrated in FIG. 5 illustrate a plurality of pleats formed on this sheet 10. The plurality of pleats are generally referred to as 12. The cut out sheet forms a pair of side edges 14 and 16, a bottom edge 18 and a top edge 20. The side edges 14 and 16 and bottom edge 18 are cut in a straight line. The top edge 20 as shown in FIG. 5 was originally cut in a straight line. However, there are arch-shaped cutouts made in the top edge in this embodiment to form four tie tabs 22. In FIG. 7, only two tie tabs are cutout for forming one pair of opposed tie tabs. The tie tabs 22 are spaced so that when the rectangular sheet 10 is curled to form a circular cylinder, the tie tabs form two pairs of opposed tie tabs which are tied together thereby sealing off the top opening of the full disposable receptacle.

The pleats 12 are generally ½ to 1½ inches wide. The pleating process for transforming the flat sheet 10 into a pleated sheet can be done by a variety of conventional pleating means and associated machines therefore. After the sheet 10 has been properly pleated, the two side ends 14 and 16 are joined together to form the circular body of the receptacle. The two side edges 14 and 16 can be glued together with an appropriate adhesive or they could be annealed to form a seam at their juncture.

A bottom portion 24 being circular in configuration is also cut out in order to become part of the bottom of the receptacle. The circular bottom portion is not shown in the figures. The only requirement is that the diameter of the circular body created when the two ends 14 and 16 are joined is less than the overall size of the bottom portion. A portion of the bottom is shown in FIG. 3 and is generally labeled 24.

Figure 3:
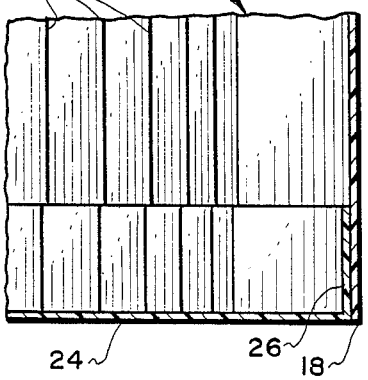
FIG. 3 is a fragmentary cross sectional view taken along the lines of 3—3 of FIG. 2 illustrating the separate bottom attached to the bottom edge of the sidewall.

As shown in FIG. 3, the circumference of the bottom portion is joined with the lower interior portion of the sidewall 10. There is a lip area 26 which is part of the circumferential area of the circular bottom which is attached to the sidewall. This circumferential part provides a relatively wide adhesion area so that the bottom has a strong connection with the sidewall to support a heavy load contained within the body of the trash receptacle.

Figure 6:
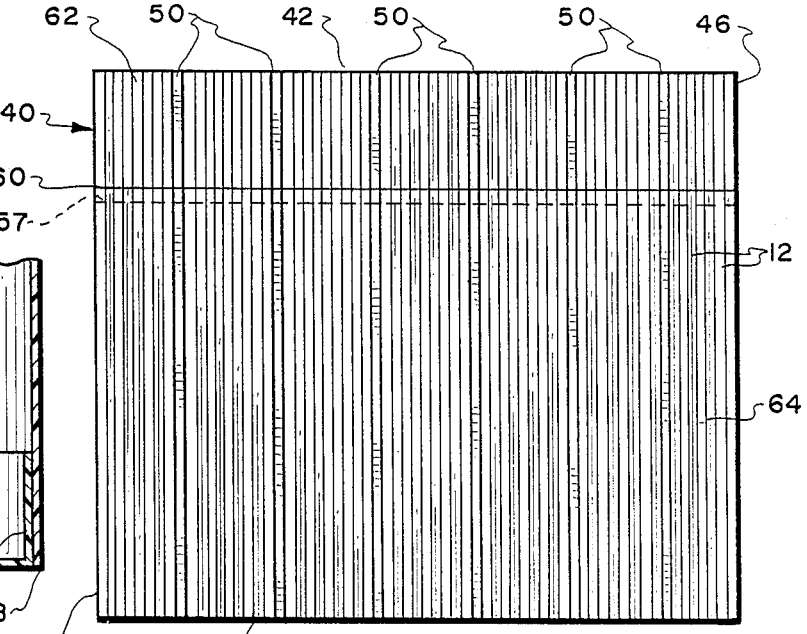
FIG. 6 illustrates an alternative embodiment of the invention. This is a view of the sidewall before the two side ends are joined together for forming a sidewall. There is illustrated a top portion without tie tabs, a plurality of vertical stiffeners spaced longitudinally and in parallel to increase the rigidity of the sidewall, a lateral crease, and a lateral support strip for increasing the rigidity of the rim area of the sidewall in addition to providing a line of demarcation for folding the upper portion of the sidewall and down around its lower portion.

FIG. 6 shows an alternative embodiment of the basic side sheet. This side sheet is generally labeled 40. It likewise has a top edge 42, a pair of side edges 44 and 46 and a bottom edge 48. The main difference in FIG. 6 is that the arch shaped cut outs forming the tie tabs 22 are missing in this embodiment. In this embodiment, the upper portion of the sidewall is simply crimped together when the trash bag is full and forming a neck for being tied off by an appropriate twist tie. The sidewall 40 illustrated in FIG. 6 has further elements and features over the basic pleated version. There is disclosed a plurality of vertical stiffeners 50 attached in a spaced relationship longitudinally and in parallel to the side edges 44 and 46. These vertical stiffener means are illustrated as strips of stiff plastic material in a thin strip or rod form which is attached to the sidewall or made into the sidewall. They can be attached in the trough area formed either on the inside or the outside crease areas. The stiffeners can be adhesively glued to the sidewall by any conventional type of adhesive or even heat annealed to the sidewall. The purpose of these vertical stiffeners is to increase the rigidity of the sidewall so that it will resist becoming limp and bend or otherwise sag when it is in the freestanding and open position as shown in FIG. 2. It is optional whether the stiffeners go all the way from the bottom edge 48 to the top edge 42 or whether or not they terminate at along this crease 60. Either way, the stiffeners will have to be broken along this crease area in order for the upper portion 62 of the sidewall above the crease to be bendable along the crease line to create the integrated lid 80 as shown in FIG. 4.

There is also disclosed a horizontal line 60 generally described as a lateral crease which is created during the fabrication of the generally rectangular sheet forming the sidewall 40. This crease line 60 provides a well defined line of demarcation for the upper portion 62 to be folded back down around the lower portion 64 of the exterior of the sidewall, thereby creating a rim surface 82 as shown in FIG. 2. When the receptacle 10 has been opened up to its freestanding position, the upper portion 62 of the sidewall is folded back down and around the lower portion to form a large opening to allow insertion of garbage and refuse into the cavity forming the receptacle. The vertical stiffeners, the edge creating the rim 82 and the pleats 12 all contribute to the stiffness and rigidity in the open freestanding receptacle 10.

Further reinforcement can be added to increase the rigidity of the rim area 82. For example, there can be a horizontal reinforcement strip applied laterally and just below the crease 60. This lateral reinforcement strip could be comprised of a relatively rigid plastic strip which has been previously pleated or having a saw-toothed cross section so that it would have a complimentary fit with the pleats already formed on the sidewall. Since the reinforcing strip should be relatively stiff, the pleating process may not allow for the reinforcement strip to be pleated with the sidewall. This is why it may occasionally be required that the reinforecement strip be previously pleated before being applied to the sidewall in a lateral or transverse fashion.

Another means by which a lateral reinforcement strip can be fabricated is before the pleating process has begun on the rectangular sheet 10. Near the area where the crease 60 would be created, one could first of all create a transverse double fold in the rectangular sheet. This, in turn, would create a transverse flap 57 which could be folded down to have one side of the flap glued or otherwise adhered to the inside or outside of the rectangular sheet. Thereafter, since the material forming the flap is the same as the rest of the sidewall material, the entire sidewall could be sent through the pleating process. This would eliminate the added step of gluing the pleated rigid plastic horizontal strip to the sidewall. In either event, the purpose of reinforcing the area below the crease 60 is to increase the rigidity of the rim opening so that the upper part of the cylinder forming the receptacle has rigidity. The optional features of the vertical stiffeners 50, the horizontal crease 60 and the lateral reinforcement means could also be applied to the basic invention shown in FIG. 5 having the plurality of tie tabs 22 at the top edge.

An alternative embodiment of the invention would comprise the sidewall only having the bottom secured to the bottom edge of the sidewall. In effect, the rim of the sidewall would terminate at the point where the lateral crease 82 would be. The end result would be a rigid freestanding sidewall without a top to seal off the contents.

Yet another alternative embodiment (not illustrated) would comprise a limp cylindrical plastic attachment to the open container discussed above. The bottom of the attachment would be secured to the top rim of the sidewall. The attachment could also be cone shaped having the base of the cone attached to the rim of the open sidewall. The tip of the cone would have a sealable opening such as a drawstring to seal off the contents of the full container.

In another alternate embodiment elaborating on the basic structure of FIG. 5, there could likewise be a horizontal crease 60 (not shown), a series of vertical stiffeners 50 (not shown) and a lateral reinforement strip (not shown) attached below the crease 60 to likewise increase the rigidity of the rim area of the basic invention.

The basic invention is fabricated by means of cutting out a rectancular sheet of appropriate material 10, submitting it to the pleating process for creating the pleats 12, providing a horizontal crease 60, joining the side ends of the sheet to form the sidewall, and attaching the circular bottom to the bottom edge thereby forming the bottom. The receptacle is now in its freestanding open upright position.

The next step is to prepare the receptacle so that it can be properly packaged. This is done by compressing inwardly the pleated sidewalls to reduce the overall diameter of the cylindrical configuration while at the same time pushing the bottom 24 up into the lower interior of the cylindrical configuration until the pleats reach a maximum compression as shown in FIG. 1. It is foreseeable that this product would be sold in multiple units within one packaging container. For example, 4 of these disposable receptacles (throw away trash cans) can be packed in one elongate rectangular box. The consumer or purchaser of the box would simply have to open up one end and pull out one of the receptacles and expand the compressed pleated sidewalls thereby causing the sidewall to expand and become erect to form the freestanding open receptacle as shown in FIG. 2. This freestanding trash receptacle can be placed in the garage or any convenient place around the home. Refuse such as trash, household garbage and the like can accumulate until such time as it is full. When the trash bag is sufficiently full, the upper portion 62 is pulled up and the pair of opposed tie tabs 22 are tied together sealing the receptacle as shown in FIG. 4.

The crease 60 is a demarcation point for the upper portion 62 to bend upwardly to form a dome shaped integrated lid with the lower portion 64 forming the sidewall. There are also included as an embodiments a pair of punch outs 90 which function as openings to insert ones hands to allow for easy transport of the full receptacle. The full receptacle is disposed of just as a traditional garbage can would be in that the trash collector, instead of emptying the contents of the full receptacle, the entire contents and receptacle would be disposed of as a unit. In effect this invention is a throw away trash can which is used only once.

While the present invention has been shown and described herein in what is conceived to be the best mode contemplated, it is recognized that departures may be made therefrom within the scope of the invention which is therefore not to be limited to the details disclosed herein, but is to be afforded the full scope of the invention.

We claim:

1. A freestanding disposable trash receptacle comprising;

a generally rectangular sheet having a top edge, a bottom edge and a pair of side edges;

said top edge comprising at least one pair of tie tabs for tieing off the top of said receptacle when said receptacle is full of refuse;

said sheet being longitudinally pleated;

said side edges being joined together to form a longitudinally pleated cylindrical sidewall when placed in an upright position;

a generally circular shaped, flexible bottom permanently joined at its circumference to said bottom rectangular edge for forming a bottom to said cylindrical sidewall;

whereby said bottom can be crimped and stuffed into said interior of said receptacle while said pleats are being folded together and compressed inwardly to form a collapsed elongate tube for transport and sale.

2. The disposable receptacle as recited in claim 1 further comprising a lateral crease spaced below said tie tabs for providing a point at which said upper portion of said sidewall above said crease can be folded back down and around said outer surface of the lower portion of said sidewall for providing a large mouth opening for said receptacle when said receptacle is in an upright and open position.

3. A freestanding disposable trash receptacle comprising;

a generally rectangular sheet having a top edge, a bottom edge and a pair of side edges;

said sheet being longitudinally pleated;

said side edges being joined together to form a longitudinally pleated cylindrical sidewall when placed in an upright position;

a generally circular shaped, flexible bottom permanently joined at its circumference to said bottom rectangular edge for forming a bottom to said cylindrical sidewall;

whereby said bottom can be crimped and stuffed into said interior while said pleats are being folded together and compressed inwardly to form a collapsed elongate tube for transport and sale.

4. A freestanding disposable trash receptacle comprising;

a generally rectangular sheet having a top edge, a bottom edge and a pair of side edges;

said sheet being longitudinally pleated;

said side edges being joined together to form a longitudinally pleated cylindrical sidewall when placed in an upright position;

a generally circular shaped, flexible bottom permanently joined at its circumference to said bottom rectangular edge for forming a bottom to said cylindrical sidewall;

whereby said bottom can be crimped and stuffed into said interior of said receptacle while said pleats are being folded together and compressed inwardly to form a collapsed elongate tube for transport and sale.

5. The trash receptacle as recited in claim 4 further comprising a separate closable top portion means made of non-rigid plastic which is attached to said upper edge of said sidewall.

6. A freestanding disposable trash receptacle comprising:

a generally rectangular sheet having a top edge, a bottom edge and a pair of side edges;

said top edge comprising at least one pair of tie tabs for forming an integral lid with said sidewall and tieing off said receptacle when said receptacle is full of refuse;

said sheet being longitudinally pleated;

said side edges being joined together to form a longitudinally pleated cylindrical sidewall when placed in an upright position;

a plurality of vertical stiffener means attached or molded in and spaced longitudinally and in parallel around said sidewall for stiffening and increasing the rigidity of said sidewall;

a laterally positioned lateral fold in said sidewall formed below said top edge for defining an upper portion and a lower portion of said sidewall and for increasing the rigidity of said sidewall by providing a rim at which said upper portion of said sidewall can be folded back down and over said sidewall while said receptacle is in an opened and upright position;

a generally circular shaped bottom joined at its circumference to said bottom rectangular edge for forming a bottom to said cylindrical sidewall;

whereby said bottom can be stuffed into said interior of said receptacle while said pleats are being folded together and compressed inwardly to form a collapsed elongate tube for transport and sale.

7. The receptacle as recited in claim 6 wherein said upper portion of said sidewall forms an integral lid for the receptacle.

8. The disposable receptacle as recited in claim 6 wherein said sidewall is comprised of a material which will hold a crease, is stiff yet pliable and is water resistant.

9. The disposable receptacle as recited in claim 6 wherein said sidewall is comprised of liner stock material supplied by Advanced Film Technology Company.

10. A freestanding disposable trash receptacle comprising:

a generally rectangular sheet having a top edge, a bottom edge and a pair of side edges;

said sheet being longitudinally pleated;

said side edges being joined together to form a longitudinally pleated cylindrical sidewall when placed in an upright position;

a lateral crease spaced below said top edge for defining an upper portion and a lower portion to said sidewall;

said lateral crease providing a line at which said upper portion of said sidewall can be folded back down upon said outer surface of said lower portion of said sidewall for providing a large mouth opening for said receptacle when said receptacle is in an upright and open position;

a generally circular shaped bottom joined at its circumference to said bottom rectangular edge for forming a bottom to said cylindrical sidewall;

whereby said bottom can be stuffed into said interior while said pleats are being folded together and compressed inwardly to form a collapsed elongate tube for transport and sale.

11. The disposable receptacle as recited in claim 10 further comprising a plurality of vertical stiffener means attached and spaced longitudinally and in parallel around said sidewall for stiffening and increasing the rigidity of said sidewall.

12. The disposable receptacle as recited in claim 10 further comprising a laterally positioned support means attached below said top edge for defining an upper portion and a lower portion of said sidewall and for increasing the rigidity of said sidewall by providing for a rim at which said upper portion of said sidewall can be folded back down and over said sidewall while said receptacle is in an opened and upright position.

13. The receptacle as recited in claim 12 wherein said lateral support means is comprised of a lateral fold in said sidewall.

14. The receptacle as recited in claim 12 wherein said lateral support means is comprised of a pleated strip of relatively stiff material.

15. The receptacle as recited in claim 10 wherein said upper portion of said sidewall forms an integral lid for the receptacle.

16. The disposable receptacle as recited in claim 10 wherein said sidewall is comprised of a linear stock material supplied by Advanced Film Technology Company.

17. The disposable receptacle as recited in claim 10 wherein said sidewall is comprised of an olefin material.

18. A freestanding disposable trash receptacle comprising;

a generally rectangular sheet having a top edge, a bottom edge and a pair of side edges;

said top edge comprising at least one pair of tie tabs for forming an integral lid with said sidewall and tieing off said receptacle when said receptacle is full of refuse;

said sheet being longitudinally pleated;

said side edges being joined together to form a longitudinally pleated cylindrical sidewall when placed in an upright position;

a plurality of vertical stiffener means attached or molded in and spaced longitudinally and in parallel around said sidewall for stiffening and increasing the rigidity of said sidewall;

a laterally positioned pleated strip of relatively stiff material on said sidewall attached below said top edge for defining an upper portion and a lower portion of said sidewall and for increasing the rigidity of said sidewall by providing a rim at which said upper portion of said sidewall can be folded back down and over said sidewall while said receptacle is in an opened and upright position;

a generally circular shaped bottom joined at its circumference to said bottom rectangular edge for forming a bottom to said cylindrical sidewall;

whereby said bottom and be stuffed into said interior of said receptacle while said pleats are being folded together and compressed inwardly to form a collapsed elongate tube for transport and sale.

19. The disposable receptacle as recited in claim 18 wherein said sidewall is comprised of a material which will hold a crease, is stiff yet pliable and is water resistant.

20. The disposable receptacle as recited in claim 18 wherein said sidewall is comprised of liner stock material supplied by Advanced Film Technology Company.

* * * * *